US008443622B2

(12) United States Patent
Kim et al.

(10) Patent No.: US 8,443,622 B2
(45) Date of Patent: May 21, 2013

(54) AIR CONDITIONER HAVING A MOVING GUIDE

(75) Inventors: Jung-Hoon Kim, Seoul (KR); Dong-Soo Moon, Seoul (KR); Ki-Won Seo, Anyang-si (KR); Deok Huh, Bucheon-si (KR)

(73) Assignee: LG Electronics Inc., Seoul (KR)

( * ) Notice: Subject to any disclaimer, the term of this patent is extended or adjusted under 35 U.S.C. 154(b) by 629 days.

(21) Appl. No.: 12/301,479

(22) PCT Filed: May 18, 2007

(86) PCT No.: PCT/KR2007/002441
§ 371 (c)(1),
(2), (4) Date: Nov. 19, 2008

(87) PCT Pub. No.: WO2007/136202
PCT Pub. Date: Nov. 29, 2007

(65) Prior Publication Data

US 2009/0107167 A1 Apr. 30, 2009

(30) Foreign Application Priority Data

May 20, 2006 (KR) ..... 10-2006-0045426

(51) Int. Cl.
*F25D 17/06* (2006.01)
*F04D 5/00* (2006.01)
*F03B 11/02* (2006.01)

(52) U.S. Cl.
USPC ..... 62/426; 62/429; 415/53.1; 415/126

(58) Field of Classification Search
USPC ..... 62/408, 411, 418, 426, 429
See application file for complete search history.

(56) References Cited

U.S. PATENT DOCUMENTS

| | | | | | |
|---|---|---|---|---|---|
| 3,116,011 | A | * | 12/1963 | Laing | 415/53.3 |
| 3,150,815 | A | * | 9/1964 | Laing | 415/53.3 |
| 3,310,228 | A | * | 3/1967 | Laing | 415/53.1 |
| 3,940,215 | A | * | 2/1976 | Hori et al. | 415/53.3 |
| 4,002,109 | A | * | 1/1977 | Hori et al. | 454/235 |
| 4,032,254 | A | * | 6/1977 | Bentz et al. | 415/53.3 |
| 4,607,565 | A | * | 8/1986 | Sugawara et al. | 454/319 |
| 4,913,622 | A | * | 4/1990 | Tanaka et al. | 415/53.3 |
| 4,958,500 | A | * | 9/1990 | Kuroda et al. | 62/89 |
| 4,958,504 | A | * | 9/1990 | Ichikawa et al. | 62/244 |

(Continued)

FOREIGN PATENT DOCUMENTS

| | | | |
|---|---|---|---|
| JP | S49-108647 | | 1/1973 |
| JP | S49-135137 | * | 3/1973 |

(Continued)

OTHER PUBLICATIONS

Korean Office Action dated May 29, 2007 for Application 10-2006-0045426.

(Continued)

*Primary Examiner* — Frantz Jules
*Assistant Examiner* — Henry Crenshaw
(74) *Attorney, Agent, or Firm* — KED & Associates, LLP

(57) ABSTRACT

An air conditioner includes a case provided with openings, a heat exchanger disposed in the case, one or more fans disposed in the case, and a variation unit that is movably disposed around the fans to vary air inlet and outlet directions.

15 Claims, 6 Drawing Sheets

U.S. PATENT DOCUMENTS

| | | | | |
|---|---|---|---|---|
| 5,056,987 | A * | 10/1991 | Tanaka et al. | 415/53.1 |
| 5,197,850 | A * | 3/1993 | Shinobu et al. | 415/53.1 |
| 2004/0168461 | A1* | 9/2004 | Park et al. | 62/262 |
| 2005/0279118 | A1* | 12/2005 | Son | 62/408 |
| 2009/0107167 | A1* | 4/2009 | Kim et al. | 62/426 |
| 2009/0113915 | A1* | 5/2009 | Kim et al. | 62/259.1 |

FOREIGN PATENT DOCUMENTS

| | | | |
|---|---|---|---|
| JP | 55-096850 | | 7/1980 |
| JP | 03-194331 | | 8/1991 |
| JP | 03-271639 | | 12/1991 |
| JP | H3-129829 | | 12/1991 |
| JP | 04-074077 | * | 3/1992 |
| JP | H04-074077 | * | 3/1992 |
| JP | 04-143527 | | 5/1992 |
| JP | 05-099445 | | 4/1993 |
| JP | 05280760 A | * | 10/1993 |
| JP | H06-147531 | * | 5/1994 |
| JP | 06-147531 | | 5/1995 |
| JP | 08-261496 | | 10/1996 |
| JP | 11-201490 | | 7/1999 |
| JP | 2001-227768 | | 8/2001 |
| JP | 2004-301-403 | | 10/2004 |
| JP | 2004-301403 | | 10/2004 |
| JP | 2005-315537 | | 11/2005 |
| KR | 1999-018226 | | 3/1999 |
| KR | 10-2004-0106050 | | 12/2004 |
| KR | 10-0644544 | | 11/2006 |

OTHER PUBLICATIONS

International PCT Search Report dated Aug. 20, 2007.

European Search Report dated Jan. 27, 2012 for Application 07746589.6.

* cited by examiner

[Fig. 1]
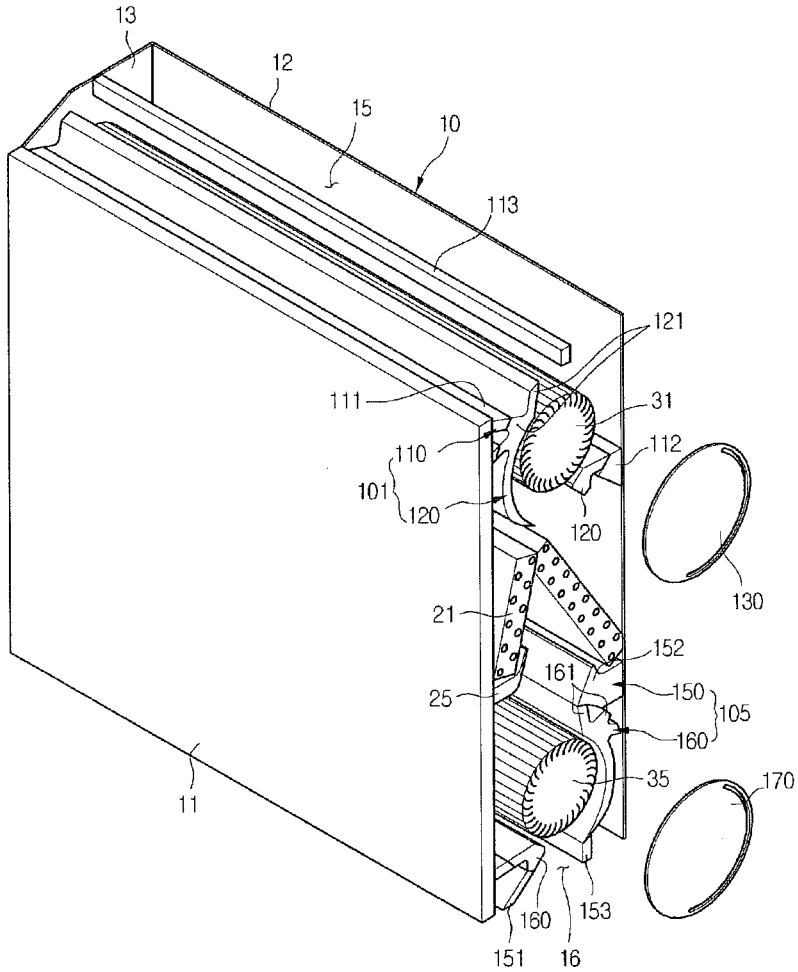

[Fig. 2]
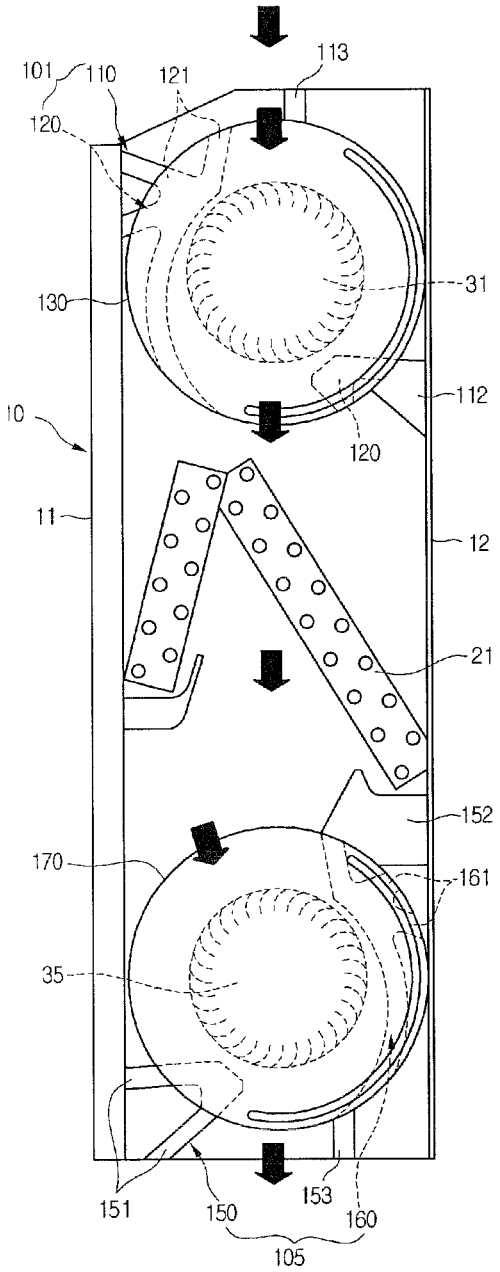

[Fig. 3]
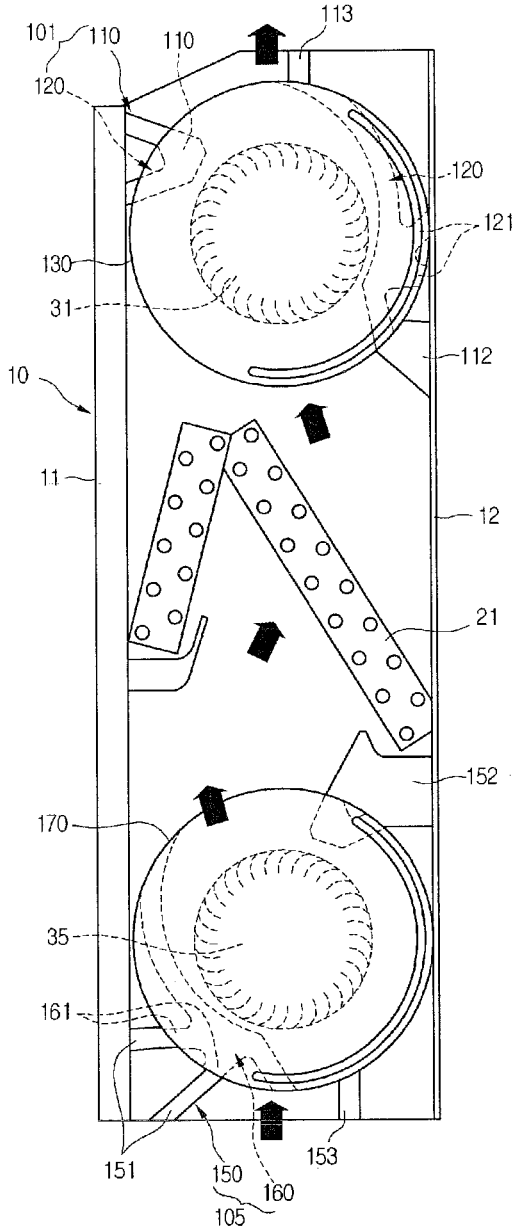

[Fig. 4]
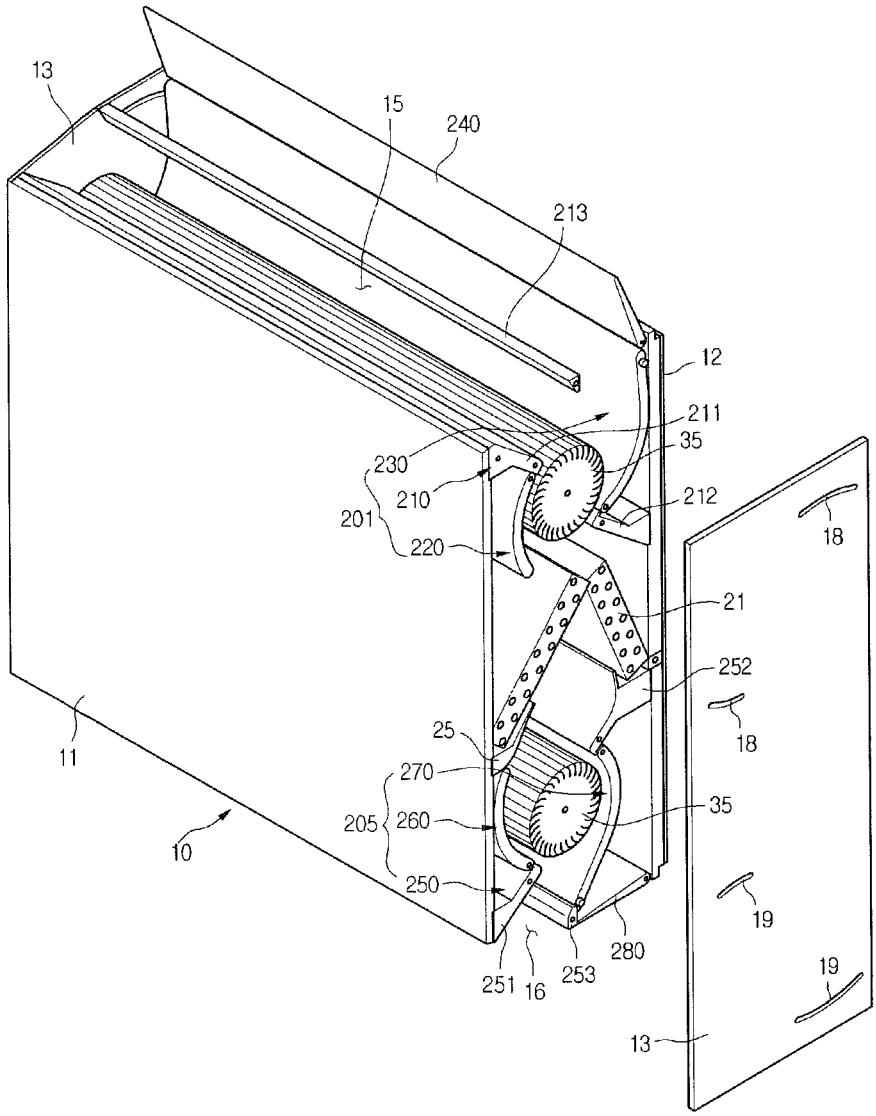

[Fig. 5]
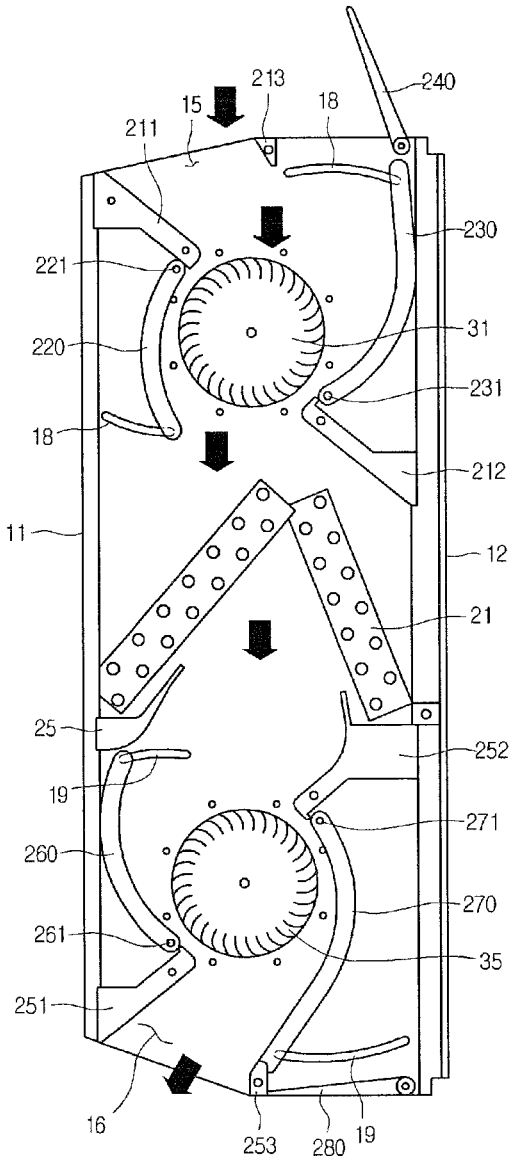

[Fig. 6]
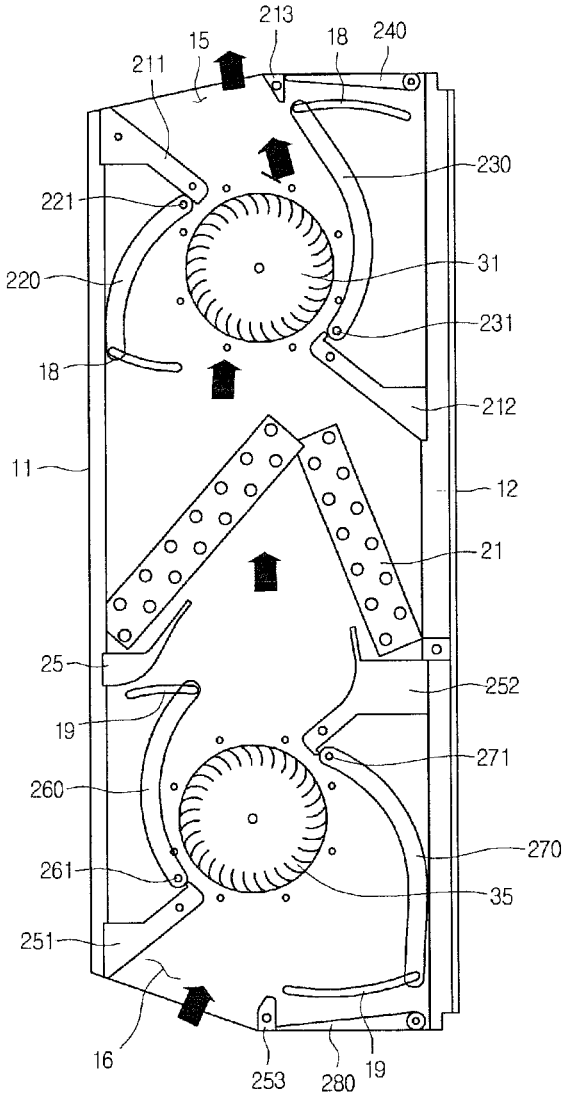

AIR CONDITIONER HAVING A MOVING GUIDE

TECHNICAL FIELD

The present disclosure relates to an air conditioner.

BACKGROUND ART

Generally, an air conditioner is an appliance for heating and cooling an indoor space. The air conditioner supplies cool air or hot air to the indoor space by operating a refrigerant cycle.

An air inlet provided in the form of a grille is disposed on a front surface of the air conditioner. An air outlet is formed on a side surface of the air conditioner. At this point, air introduced through the air inlet is discharged into the indoor space through the air outlet via a heat exchanger.

However, since the air inlet and outlet are perpendicularly disposed at the case, it is occurred airflow resistance and noise during the air conditioner is operated.

Since the air inlet provided in the form of the grille is disposed on the front surface of the air conditioner, the design of freedom of the air conditioner is significantly deteriorated.

Further, since the air inlet and the air outlet are fixed in the air conditioner, the air conditioner may not be sometimes installed at a specific place due to the limited air inlet and outlet directions.

Further, when the air conditioner is a wall-mounting type or a ceiling type, the air inlet is visually exposed. This deteriorates the outer appearance of the air conditioner. Furthermore, since foreign objects such as dusts contained in the air are adhered to the air inlet, the air inlet should be frequently cleaned since the air inlet is exposed.

DISCLOSURE OF INVENTION

Technical Problem

Embodiments provide an air conditioner that can reduce an airflow resistance and noise.

Embodiments also provide an air conditioner that can improve a design of freedom and an installation of freedom.

Embodiments also provide an air conditioner that is designed to minimize the visual exposure of an air inlet.

Technical Solution

In one embodiment, an air conditioner includes a case provided with openings; a heat exchanger disposed in the case; one or more fans disposed in the case; and a variation unit that is movably disposed around the fans to vary air inlet and outlet directions.

The fan may be a cross flow fan.

The variation unit may include a fixing guide disposed around the fan; and a moving guide that is movably disposed around the fan to vary the air inlet and outlet directions.

The moving guide may be installed to be capable of pivoting along a circumference of the fan.

The moving guide may further include a rotational member that is coupled to at least one end of the moving guide to rotate the moving guide.

The moving guide may be hinge-coupled to a circumference of the fan.

The moving guide may be rounded.

First and second ends of the moving guide may be spaced apart from the outer circumference of the fan by different distances.

The openings may be formed opposing each other.

The fans may be disposed at both sides of the heat exchanger.

The air conditioner according to claim 10, wherein the fans rotates at different RPMs.

In another embodiment, an air conditioner includes a case provided with openings; a heat exchanger disposed in the case; a pair of cross flow fans arranged at both sides of the heat exchanger; and a variation unit that is disposed to vary fluid passage areas near openings of the cross flow fans and the heat exchanger and thus to vary air inlet and outlet directions.

The variation unit may include a fixing guide disposed around the cross flow fan; and a moving guide is movably disposed around the cross flow fans to vary the fluid passage areas near the openings of the cross flow fans and the heat exchanger.

The moving guide is disposed to be capable of pivoting along circumferences of the cross flow fans.

The moving guide may be hinge-coupled to circumferences of the cross flow fan.

The moving guide may be rounded.

First and second ends of the moving guide may be spaced apart from the outer circumference of the cross flow fan by different distances.

The openings may be formed opposing each other.

The cross flow fans may rotate at different RPMs.

The cross flow fan disposed near the outlet may rotate at a relatively higher RPM.

Advantageous Effects

According to the embodiments, since the air passage of the air conditioner is linearly formed, the airflow resistance and noise of the air conditioner can be reduced.

In addition, since the air inlet and outlet of the air conditioner can be varied, the design of freedom and the installation of freedom can be enhanced.

Further, the visual exposure of the air inlet and outlet can be minimized.

BRIEF DESCRIPTION OF THE DRAWINGS

FIG. 1 is a perspective view of an air conditioner according to an embodiment of the present invention.

FIG. 2 is a side view illustrating an airflow direction of the air conditioner of FIG. 1.

FIG. 3 is a side view illustrating a case where an airflow direction of the air conditioner of FIG. 1 varies.

FIG. 4 is a perspective view of an air conditioner according to a second embodiment of the present invention.

FIG. 5 is a side view illustrating an airflow direction of the air conditioner of FIG. 4.

FIG. 6 is a side view illustrating a case where an airflow direction of the air conditioner of FIG. 4.

BEST MODE FOR CARRYING OUT THE INVENTION

Reference will now be made in detail to the embodiments of the present disclosure, examples of which are illustrated in the accompanying drawings.

Referring to FIG. 1, an air conditioner includes a case provided with openings 15 and 16. The openings 15 and 16 are forming to opposite to each other. The front and rear surfaces of the case 10 are closed.

A heat exchanger 21 is disposed in the case 10. The heat exchanger 21 has a bent shape. The heat exchanger 21 functions as an evaporator or a condenser as expansion or high temperature refrigerants are supplied thereto. At this point, supporting members 25 for supporting opposite ends of the heat exchanger 21 are formed on the front and rear surfaces of the case 10, respectively.

One or more fans 31 and 35 are disposed in the case 10. The fans 31 and 35 may be disposed above and below the heat exchanger 21. Cross flow fans that introduce the air introduced in a radial direction and exhaust the air in the radial direction may be used as the fans 31 and 35. The cross flow fans 31 and 35 rotate by a motor. At this point, the cross flow fans 31 and 35 may rotate by a common motor or individually rotate by respective motors. The cross flow fans 31 and 35 may rotate with different RPMs.

Moving units 101 and 105 for varying the air inlet and outlet directions is movably disposed around the cross flow fans 31 and 35. The moving unit 101, 105 includes a fixing guide 110, 150 and a moving guide 120, 160. The fixing guide 110, 150 and the moving guide 120, 160 are disposed along a length of the cross flow fan 31, 35.

The fixing guides 110 and 150 are fixed on a front portion 11, a rear portion 12, and side portions 13 of the case 10. At this point, front fixing guide portions 111 and 151 of the fixing guides 110 and 150 are fixed on the front portion of the case 10. Rear fixing guide portions 112 and 152 of the fixing guide 110 and 150 are fixed on the rear portion 12. Upper and lower fixing guide portions 113 and 153 of the fixing guides 110 and 150 are fixed on the side portions 13. The front and rear fixing guide portions 111, 112 and 151, 152 are disposed on opposite sides with reference to the fans 31 and 35. At this point, the front fixing guide portions 111 and 151 may be disposed at relatively higher or lower level as compared with the rear fixing guide portions 112 and 152. Needless to say, the front and rear fixing guide portions 111, 112, 151 and 152 may be disposed at a same level.

A first end of the fixing guide 110, 150 is disposed near an outer circumference of the cross flow fan 31, 35. Furthermore, the fixing guide 110, 150 may be integrally formed with the front and rear portions 11 and 12 of the case 10 or coupled to the front and rear portions 11 and 12 of the case 10 by fasteners. The fixing guide 110, 150 prevents the air from flowing back when the cross flow fan 31, 35 rotates.

The moving guide 120, 160 is movably disposed around the cross flow fan 31, 35 to vary the air inlet and outlet directions. The moving guide 120, 160 may be installed to be capable of pivoting along the circumference of the cross fan 31, 35. At this point, the moving guide 120, 160 may have a pivotal track of about 270 about a rotational center of the cross flow fan 31, 35.

The moving guide 120, 160 is rounded to partly enclose the circumference of the fan 31, 35. The moving guide 120, 160 has first and second ends that are spaced apart from the fan 31, 35 by different distances. Therefore, as the moving guide 120, 160 pivots along the circumference of the cross flow fan 31, 35, the upper and lower openings 15 and 16 vary to the air outlet or the air inlet. For example, when the upper opening 15 varies to the air inlet, the lower opening 16 varies to the air outlet. On the other hand, when the upper opening 15 varies to the air outlet, the lower opening 16 varies to the air inlet.

By the pivoting of the moving guide 120, 160, fluid passage areas near the opening 15, 16 of the cross flow fan 31 and the heat exchanger 21 vary and thus the air inlet and outlet directions vary. At this point, when the fluid passage area near the opening 15, 16 is larger than that near the heat exchanger 21, the opening 15, 16 becomes the air inlet. In addition, when the fluid passage area near the opening 15, 16 is less than that near the heat exchanger 21, the opening 15, 16 becomes the air outlet. At this point, the cross fan 31, 35 always rotates in an identical direction regardless of the function of the opening 15, 16.

Further, extending ribs 121, 161 are formed on a surface of the moving guide 120, 160. The extending ribs 121, 161 abut the fixing guide 110, 150 when the moving guide 120, 16 rotates. The extending ribs 121, 161 form partly the fluid passage of the cross fan 31, 35 by abutting the fixing guide 110, 150. Although three extending ribs 121 and 161 are formed on the moving guide 120, 160 in FIG. 2, the number of the extending ribs 121, 161 may vary in accordance with a shape of the fixing guide 110, 150.

A rotational member 130, 170 may be coupled to an end of the moving guide 120, 160. The rotational member 130, 170 is disc-shaped. A motor unit may be connected to the rotational member 130, 170. Therefore, as the motor unit is driven, the rotational member 13, 170 and the moving guide 120, 160 rotate together with the motor unit. Further, when the motor unit is not connected to the rotational member 130, 170, the rotational member 120, 170 may rotate manually.

The following will describe an operation of the air conditioner structured as described above.

Referring to FIG. 2, when the upper moving guide 120 pivots frontward, the two extending ribs 121 of the upper moving guide 120 abut the front fixing guide portion 111. The rear fixing guide portion 112 is located near the outer circumference of the cross flow fan 31. At this point, since the fluid passage area near the upper opening 15 is larger than the fluid passage area near the heat exchanger 21, the upper opening 15 becomes the air inlet. FIG. 2 shows a first airflow (the uppermost arrow) flowing into the upper opening 15 in an air inlet direction.

In addition, when the lower moving guide 160 pivots rearward, one extending rib 161 of the lower moving guide 160 abuts the rear fixing guide portion 152. In addition, an end of the lower moving guide 160 abuts the lower fixing guide 153. Further, the rear fixing guide 160 is located near the outer circumference of the lower cross flow fan 35. At this point, since the fluid passage area near the lower opening 16 is less than the fluid passage area near the heat exchanger 21, the lower opening 16 becomes the air outlet.

The upper and lower cross flow fans 31 and 35 rotate. At this point, the RPM of the lower cross flow fan 35 may be higher than that of the upper cross flow fan 31. In this case, since the lower cross flow fan 35 can form a relatively low pressure in the case 10, the airflow performance can be improved. Needless to say, the upper and lower cross flow fans 31 and 35 may rotate at identical RPMs.

The air introduced through the upper opening 15 heat-exchanges while passing through the heat exchanger 21. The heat-exchanged air is discharged to the indoor space through the lower opening 16. As described above, since the air flows along an almost straight path in the air conditioner, the airflow resistance and noise can be significantly reduced in the air conditioner.

Referring to FIG. 3, when the upper moving guide 120 pivots rearward, the extending rib 121 of the upper moving guide 120 abuts the rear fixing guide 113. Further, an end of the upper moving guide 120 abuts the upper fixing guide 113. In addition, the front fixing guide portion 111 is located near the outer circumference of the upper cross flow fan 31. At this point, since the fluid passage area near the upper opening 15 is less than the fluid passage area near the heat exchanger 21, the upper opening 15 becomes the air outlet.

Further, when the lower moving guide 160 pivots frontward, the two extending ribs 161 of the lower moving guide 160 abut the front fixing guide 161. The rear fixing guide 162 is located near the outer circumference of the lower cross flow fan 35. At this point, since the fluid passage area near the lower opening 16 is greater than the fluid passage area near the heat exchanger 21, the lower opening 16 becomes the air inlet. FIG. 3 shows a second airflow (the lowermost arrow) flowing into the lower opening 16 in an air inlet direction.

The upper and lower cross flow fans 31 and 35 rotate. At this point, the RPM of the upper cross flow fan 31 may be higher than that of the lower cross flow fan 35. In this case, since the upper cross flow fan 31 forms a relatively low pressure in the case 10, the airflow performance can be improved. Needless to say, the upper and lower cross flow fans 31 and 35 may rotate at identical RPMs.

The air introduced through the lower opening 16 heat-exchanges while passing through the heat exchanger 21. The heat-exchanged air is discharged to the indoor space through the upper opening 15. As described above, since the air flows along an almost straight path in the air conditioner, the airflow resistance and noise can be significantly reduced in the air conditioner.

The following will described an air conditioner according to a second embodiment of the present invention.

Referring to FIG. 4, an air conditioner includes a case provided with openings 15 and 16. The openings 15 and 16 are forming to opposite to each other. A heat exchanger 21 is disposed in the case 10. The heat exchanger 21 has a bent shape. Supporting members 25 are formed on the front and rear surfaces of the case 10, respectively.

One or more fans 31 and 35 are disposed in the case 10. The fans 31 and 35 may be disposed at opposite sides of the heat exchanger 21. Cross flow fans may be used as the fans 31 and 35. The cross flow fans 31 and 35 rotate by a motor, The cross flow fans 31 and 35 may rotate with different RPMs.

Moving units 201 and 205 for varying the air inlet and outlet directions is hinge-coupled around the cross flow fans 31 and 35. The moving unit 201, 205 includes a fixing guide 210, 250 and a moving guide 120, 160, 260, 270.

The fixing guides 210 and 250 are fixed on a front portion 11, a rear portion 12, and side portions 13 of the case 10. At this point, front fixing guide portions 211 and 251 of the fixing guides 210 and 250 are fixed on the front portion of the case 10. Rear fixing guide portions 212 and 252 of the fixing guide 210 and 250 are fixed on the rear portion 12. Upper and lower fixing guide portions 213 and 253 of the fixing guides 210 and 250 are fixed on the side portions 13. The front and rear fixing guide portions 211, 212 and 251, 252 are disposed on opposite sides with reference to the fans 31 and 35. At this point, the front fixing guide portions 211 and 251 may be disposed at relatively higher or lower level as compared with the rear fixing guide portions 212 and 252.

A first end of the fixing guide 210, 250 is disposed near an outer circumference of the cross flow fan 31, 35. Furthermore, the fixing guide 210, 250 may be integrally formed with the front and rear portions 11 and 12 of the case 10 or coupled to the front and rear portions 11 and 12 of the case 10 by fasteners. The fixing guide 210, 250 prevents the air from flowing back when the cross flow fan 31, 35 rotates.

The moving guide 220, 260 is higedly coupled around the cross flow fan 31, 35 to vary the air inlet and outlet directions. A first end of the moving guide 220, 230, 260, 270 is hinge-coupled. In order to reduce the flow resistance, the first end of the moving guide 220, 230, 260, 270 is disposed near a first end of the fixing guide 210, 250. Thin, long slots 18 and 19 are formed on the side surfaces 13 of the case 10. The second end of the moving guide 220, 230, 260, 270 is movably coupled to the slot 18, 19. The moving guides 220, 230, 260, and 270 are arranged in front and rear of the cross flow fans 31 and 25 by one.

The moving guide 220, 230, 260, 270 is rounded to partly enclose the circumference of the fan 31, 35. The moving guide 220, 230, 260, 270 has first and second ends that are spaced apart from the fan 31, 35 by different distances. Therefore, as the moving guide 220, 230, 260, 270 pivots along the circumference of the cross flow fan 31, 35 about a hinge, the openings 15 and 16 vary to the air outlet or the air inlet. For example, when the upper opening 15 varies to the air inlet, the lower opening 16 varies to the air outlet. On the other hand, when the upper opening 15 varies to the air outlet, the lower opening 16 varies to the air inlet.

By the pivoting of the moving guide 220, 230, 260, 270 pivots about a hinge 221, 231, 261, 271, fluid passage areas near the opening 15, 16 of the cross flow fan 31 and the heat exchanger 21 vary and thus the air inlet and outlet directions vary. At this point, when the fluid passage area near the opening 15, 16 is larger than that near the heat exchanger 21, the opening 15, 16 becomes the air inlet. In addition, when the fluid passage area near the opening 15, 16 is less than that near the heat exchanger 21, the opening 15, 16 becomes the air outlet. At this point, the cross fan 31, 35 always rotates in an identical direction regardless of the function of the opening 15, 16.

Further, louvers 240 and 280 for partly closing the openings 15 and 16 may be provided on the moving units 201 and 205. The louvers 240 and 280 have a length such that they can abut the fixing guides 210 and 250 when they partly close the openings 15 and 16. A motor unit may be connected to the moving guide 220, 230, 260, 270. Therefore, as the motor unit is driven, the moving guide 220, 230, 260, 270 rotate together with the motor unit. Further, when the motor unit is not connected to the moving guide 220, 230, 260, 270, the moving guide 220, 230, 260, 270 may rotate manually.

The following will describe an operation of the air conditioner structured as described above.

Referring to FIG. 5, the upper moving guide 220 pivots toward the cross flow fan 31 about the hinge 221, and the upper moving guide 230 rotates away from the cross flow fan 31 about the hinge 231. The upper louver 240 is opened. At this point, since the fluid passage area near the upper opening 15 is larger than the fluid passage area near the heat exchanger 21, the upper opening 15 becomes the air inlet.

In addition, the lower moving guide 260 pivots away from the cross flow fan 31 about the hinge 261, and the lower moving guide rotates toward the cross flow fan 35 about the hinge 271. The lower louver 280 is closed. At this point, since the fluid passage area near the lower opening 16 is less than the fluid passage area near the heat exchanger 21, the upper opening 15 becomes the air outlet.

The upper and lower cross flow fans 31 and 35 rotate. At this point, the RPM of the lower cross flow fan 35 may be higher than that of the upper cross flow fan 31. In this case, since the lower cross flow fan 35 can form a relatively low pressure in the case 10, the airflow performance can be improved. Needless to say, the upper and lower cross flow fans 31 and 35 may rotate at identical RPMs.

The air introduced through the upper opening 15 heat-exchanges while passing through the heat exchanger 21. The heat-exchanged air is discharged to the indoor space through the lower opening 16. As described above, since the air flows along an almost straight path in the air conditioner, the airflow resistance and noise can be significantly reduced in the air conditioner.

Referring to FIG. 6, the upper moving guide 220 pivots away from the cross flow fan 31 about the hinge 221, and the upper moving guide 230 rotates toward the cross flow fan 31 about the hinge 231. The upper louver 240 is closed. At this point, since the fluid passage area near the upper opening 15 is less than the fluid passage area near the heat exchanger 21, the upper opening 15 becomes the air outlet.

In addition, the lower moving guide 260 pivots toward the cross flow fan 31 about the hinge 261, and the lower moving guide rotates away from the cross flow fan 35 about the hinge 271. The lower louver 280 is opened. At this point, since the fluid passage area near the lower opening 16 is greater than the fluid passage area near the heat exchanger 21, the upper opening 15 becomes the air inlet.

The upper and lower cross flow fans 31 and 35 rotate. At this point, the RPM of the lower cross flow fan 35 may be higher than that of the upper cross flow fan 31.

The air introduced through the lower opening 16 heat-exchanges while passing through the heat exchanger 21. The heat-exchanged air is discharged to the indoor space through the upper opening 15. As described above, since the air flows along an almost straight path in the air conditioner, the airflow resistance and noise can be significantly reduced in the air conditioner.

Industrial Applicability

According to the present invention, noise of the air conditioner can be reduced and the installation and design of freedom can be improved. Hence, the industrial applicability is very high.

The invention claimed is:

1. An air conditioner comprising:

a case provided with a first opening to define an air inlet and a second opening to define an air outlet, the case provided with a slot having a first slot end and a second slot end;

a heat exchanger disposed in the case;

a pair of cross flow fans arranged at both sides of the heat exchanger to produce airflow; and a variation unit that is disposed to vary fluid passage areas near openings of the cross flow fans and the heat exchanger and thus to vary air inlet and outlet directions, the variation unit includes:

a plurality of moving guides installed to be capable of pivoting along a circumference of the fans, at least one of the moving guides configured to change the first opening to the air outlet and to change the second opening to the air inlet according to a direction of pivoting the at least one of the moving guides, wherein the at least one of the moving guides does not block at least one portion of the air inlet and the air outlet when the at least one of the moving guides is pivoted, and a hinge portion provided at the case to provide a center of rotation of one of the moving guides, wherein the plurality of moving guides includes a first moving guide disposed around a first one of the cross flow fans and rotating in a first direction and a second moving guide disposed around a second one of the cross flow fans and rotating in a second direction, and the first direction and the second direction are opposed to each other, and wherein at least one of the first and second moving guides includes a first end coupled to the hinge portion and a second end coupled to the slot, and the second end moves between the first slot end and the second slot end when the first or second moving guide rotates.

2. The air conditioner according to claim 1, wherein the variation unit further includes a fixing guide disposed around one of the cross flow fans.

3. The air conditioner according to claim 1, wherein at least one of the moving guides is rounded.

4. The air conditioner according to claim 1, wherein at least one of the moving guides comprises the first and second ends spaced apart from an outer circumference of the cross flow fan by different distances.

5. The air conditioner according to claim 1, wherein the first opening and the second opening of the case are formed opposing each other.

6. The air conditioner according to claim 1, wherein the cross flow fans rotate at different RPMs.

7. The air conditioner according to claim 1, wherein a cross flow fan disposed near the air outlet rotates at a higher RPM than a cross flow fan disposed near the air inlet.

8. The air conditioner according to claim 2, wherein the variation unit further includes at least one louver for partly closing the first or second opening, and wherein the louver has a length such that the louver abuts the fixing guide when the louver partly close the first or second opening.

9. An air conditioner comprising:

a case having a first opening and a second opening, the first opening being an air inlet, and the second opening being an air outlet, the case including a slot that extends from a first slot end to a second slot end;

a heat exchanger in the case;

a pair of cross flow fans at sides of the heat exchanger to produce airflow; and a variation unit to vary air inlet and outlet directions, the variation unit including:

a plurality of moving guides to pivot along a circumference of the corresponding fan, a first moving guide to change the first opening to the air outlet and to change the second opening to the air inlet based on a direction of pivoting the first moving guide, wherein the first moving guide does not block at least one portion of the air inlet and the air outlet when the first moving guide is pivoted, and a hinge portion provided at the case to provide rotation of the first moving guide, wherein the plurality of moving guides includes the first moving guide disposed around a portion of a first one of the cross flow fans and to rotate in a first direction and a second moving guide disposed around a portion of a second one of the cross flow fans and to rotate in a second direction, and the first direction being different than the second direction, and wherein the first moving guide has a first end coupled to the hinge portion and a second end provided at the slot, and the second end of the first moving guide to move in the slot to a plurality of positions between the first slot end and the second slot end when the first moving guide moves.

10. The air conditioner according to claim 9, wherein the variation unit further includes a fixing guide around a portion of one of the cross flow fans.

11. The air conditioner according to claim 10, wherein the variation unit further includes a louver to partly close the first opening, and wherein the louver has a length such that the louver abuts the fixing guide when the louver partly closes the first opening.

12. The air conditioner according to claim 9, wherein the first opening and the second opening of the case are formed to oppose each other.

13. The air conditioner according to claim 9, wherein the cross flow fans rotate at different RPMs.

14. The air conditioner according to claim 9, wherein the cross flow fan disposed nearest the air outlet rotates at a higher RPM than the cross flow fan disposed nearest the air inlet.

15. The air conditioner according to claim 9, wherein the first moving guide is rounded.

* * * * *